US007890007B2

(12) United States Patent
Tsuchiya

(10) Patent No.: US 7,890,007 B2
(45) Date of Patent: Feb. 15, 2011

(54) IMAGE FORMATION APPARATUS, AN IMAGE FORMATION METHOD, AN IMAGE FORMATION PROGRAM, AND A COMPUTER-READABLE RECORDING MEDIUM

(75) Inventor: Fuminori Tsuchiya, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 837 days.

(21) Appl. No.: 11/700,809

(22) Filed: Jan. 30, 2007

(65) Prior Publication Data

US 2007/0183799 A1 Aug. 9, 2007

(30) Foreign Application Priority Data

Feb. 9, 2006 (JP) ..... 2006-032388

(51) Int. Cl.
*G03G 15/08* (2006.01)
*G03G 15/00* (2006.01)

(52) U.S. Cl. ..... 399/53; 399/44

(58) Field of Classification Search ..... 399/53, 399/91, 94, 97

See application file for complete search history.

(56) References Cited

U.S. PATENT DOCUMENTS

| | | | | |
|---|---|---|---|---|
| 5,523,832 | A * | 6/1996 | Hamamichi et al. | 399/254 |
| 7,319,826 | B2 * | 1/2008 | Shim | 399/12 |
| 2005/0129421 | A1 * | 6/2005 | Onishi | 399/38 |

FOREIGN PATENT DOCUMENTS

| | | |
|---|---|---|
| JP | 11-84872 | 3/1999 |
| JP | 2001-235912 | 8/2001 |
| JP | 2004-347726 | 12/2004 |

* cited by examiner

*Primary Examiner*—David P Porta
*Assistant Examiner*—Carolyn Igyarto
(74) *Attorney, Agent, or Firm*—Cooper & Dunham LLP

(57) ABSTRACT

An image formation apparatus, an image formation method, an image formation program, and a computer-readable recording medium are provided, a rotation of the developer supply roller is controlled in order to prevent plugging of the developer supply roller based on quality information and environmental information.

11 Claims, 5 Drawing Sheets

FIG.3

| PRINTING REQUEST | ENVIRONMENTAL CONDITION | PREVENTIVE OPERATION BEFORE PRINTING | PREVENTIVE OPERATION DURING PRINTING | PREVENTIVE OPERATION AFTER PRINTING |
|---|---|---|---|---|
| SPEED IMPORTANT | POOR | NO OPERATION | POSITIVE ROTATION AT FULL SPEED FOR 10 SECONDS EVERY 600 SECONDS | POSITIVE ROTATION AT FULL SPEED FOR 4 SECONDS AND NEGATIVE ROTATION AT FULL SPEED FOR 2 SECONDS |
| | NORMAL | NO OPERATION | NO OPERATION | POSITIVE ROTATION AT FULL SPEED FOR 4 SECONDS AND NEGATIVE ROTATION AT FULL SPEED FOR 2 SECONDS |
| | GOOD | NO OPERATION | NO OPERATION | NO OPERATION |
| NORMAL | POOR | NO OPERATION | POSITIVE ROTATION AT FULL SPEED FOR 10 SECONDS EVERY 180 SECONDS | POSITIVE ROTATION AT FULL SPEED FOR 4 SECONDS AND NEGATIVE ROTATION AT FULL SPEED FOR 2 SECONDS |
| | NORMAL | NO OPERATION | POSITIVE ROTATION AT FULL SPEED FOR 10 SECONDS EVERY 300 SECONDS | POSITIVE ROTATION AT FULL SPEED FOR 4 SECONDS AND NEGATIVE ROTATION AT FULL SPEED FOR 2 SECONDS |
| | GOOD | NO OPERATION | NO OPERATION | NO OPERATION |
| QUALITY IMPORTANT | POOR | POSITIVE ROTATION AT FULL SPEED FOR 2 SECONDS | POSITIVE ROTATION AT FULL SPEED FOR 2 SECONDS EVERY SHEET | POSITIVE ROTATION AT FULL SPEED FOR 4 SECONDS AND NEGATIVE ROTATION AT FULL SPEED FOR 2 SECONDS |
| | NORMAL | POSITIVE ROTATION AT FULL SPEED FOR 2 SECONDS | POSITIVE ROTATION AT FULL SPEED FOR 10 SECONDS EVERY 300 SECONDS | POSITIVE ROTATION AT FULL SPEED FOR 4 SECONDS AND NEGATIVE ROTATION AT FULL SPEED FOR 2 SECONDS |
| | GOOD | POSITIVE ROTATION AT FULL SPEED FOR 2 SECONDS | NO OPERATION | NO OPERATION |

IMAGE FORMATION APPARATUS, AN IMAGE FORMATION METHOD, AN IMAGE FORMATION PROGRAM, AND A COMPUTER-READABLE RECORDING MEDIUM

BACKGROUND OF THE INVENTION

1. Technical Field

This disclosure relates to an image formation apparatus, an image formation method, an image formation program, and a computer-readable recording medium.

2. Description of the Related Art

A conventional method of preventing plugging by toner, a component of developer that is supplied from a toner holder to a development unit of an image formation apparatus, of a toner supply roller is proposed. For example, the method gives vibration to the toner supply roller at predetermined intervals by a vibrating unit that is arranged adjacent to a shaft that supports the toner supply roller or an outside surface of the toner supply roller (for example, Patent Reference 1).

[Patent reference 1] JPA 11-84872

However, the conventional method has the problem that the vibrator unit is required to include an expensive component such as a piezo-electric vibrator (such as crystal), a porcelain vibrator (such as one using barium titanate), or a magneto-strictive vibrator (such as a ferrite). Further, in order to protect the expensive vibrator, the configuration tends to be complicated, adding further costs.

SUMMARY

In an aspect of this disclosure, there are provided an image formation apparatus, an image formation method, an image formation program, and a computer-readable recording medium, whereby toner plugging, apparatus breakdown, and apparatus damage are prevented without a special mechanical configuration.

In an exemplary embodiment (FIG. 2A), there is provided an image formation apparatus, wherein a developer (toner) supply roller supplies a developer (toner) to a development unit, the image formation apparatus including, a quality information acquiring unit (for example, 201*a* in FIG. 2A) for acquiring a quality information set chosen by a user out of two or more predefined quality information sets about the quality of image formation, an environmental information acquiring unit (for example, 201*b* in FIG. 2A) for acquiring an environmental information set about the present operational environment out of two or more predetermined environmental information sets about the operational environment of image formation, and a controlling unit (for example, 201*c* in FIG. 2A) for controlling rotation of the developer (toner) supply roller (for example, 201*d* in FIG. 2A) in order to prevent plugging of the developer supply roller when forming an image based on the acquired quality information and the acquired environmental information.

According to another embodiment, the image formation apparatus includes a storage unit for storing a table wherein information about contents of the control to be performed by the controlling unit is associated with the quality information and the environmental information, wherein the controlling unit controls the rotational speed, the direction of the rotation, and the rotation time of the developer supply roller based on the table stored in the storage unit.

According to another embodiment, the image formation apparatus controls the developer supply roller with a combination of control before the image formation, control performed during the image formation, and control after the image formation based on the table stored in the storage unit.

According to another embodiment, the controlling unit measures an interval during which the image formation apparatus has been in a non-operating state (for example, with the power source turned off, or in an energy-saving mode), and rotates the developer supply roller at a predetermined speed for a predetermined time before the image formation, if the measured interval is greater than a predetermined interval.

In the aforementioned embodiment, an image formation method may be provided, wherein a developer supply roller supplies a developer to a development unit, the image formation method including, a quality information acquisition step of acquiring a quality information set chosen by a user out of two or more predefined quality information sets about the quality of image formation, an environmental information acquisition step of acquiring an environmental information set about the present operational environment out of two or more predetermined environmental information sets about the operational environment of image formation, and a control step of controlling rotation of the developer supply roller in order to prevent plugging of the developer supply roller when forming an image based on the acquired quality information and the acquired environmental information.

According to another aspect of the embodiment of the present invention, the control step of the image formation method controls the rotational speed, the rotational direction, and the rotation time of the developer supply roller based on stored information, which stored information includes contents of control to be carried out at the control step which contents are associated with the acquired quality information and the environmental information.

According to another embodiment, the control step of the image formation method controls the rotational speed, the rotational direction, and the rotation time of the developer supply roller based on stored information, which stored information includes contents of control to be carried out at the control step which contents are associated with the acquired quality information and the environmental information.

According to another embodiment, the control step of the image formation method controls the developer supply roller by combining control performed before the image formation, control performed during the image formation, and control after the image formation based on the stored information.

According to another embodiment, the control step measures an interval during which the image formation apparatus is in the non-operating state, and rotates the developer supply roller for a predetermined time at a predetermined speed before the image formation, if the measured interval is greater than a predetermined interval.

In the aforementioned embodiment, an image formation program can be provided for a computer to perform the image formation method of the present invention.

In the aforementioned embodiment, a computer-readable recording medium can be provided that stores the image formation program of the present invention.

With the image formation apparatus, the image formation method, the image formation program, and the computer-readable recording medium according to the embodiment of the present invention, plugging of a toner supply roller can be prevented with a simple configuration wherein the rotation of the toner supply roller is controlled so that an apparatus breakdown and damage can be prevented.

BRIEF DESCRIPTION OF THE DRAWINGS

FIG. 3 gives a table of contents of a toner plugging preventive operation carried out by the image formation apparatus according to the exemplary embodiment of FIG. 1.

DESCRIPTION OF THE PREFERRED EMBODIMENTS

Figure 1:
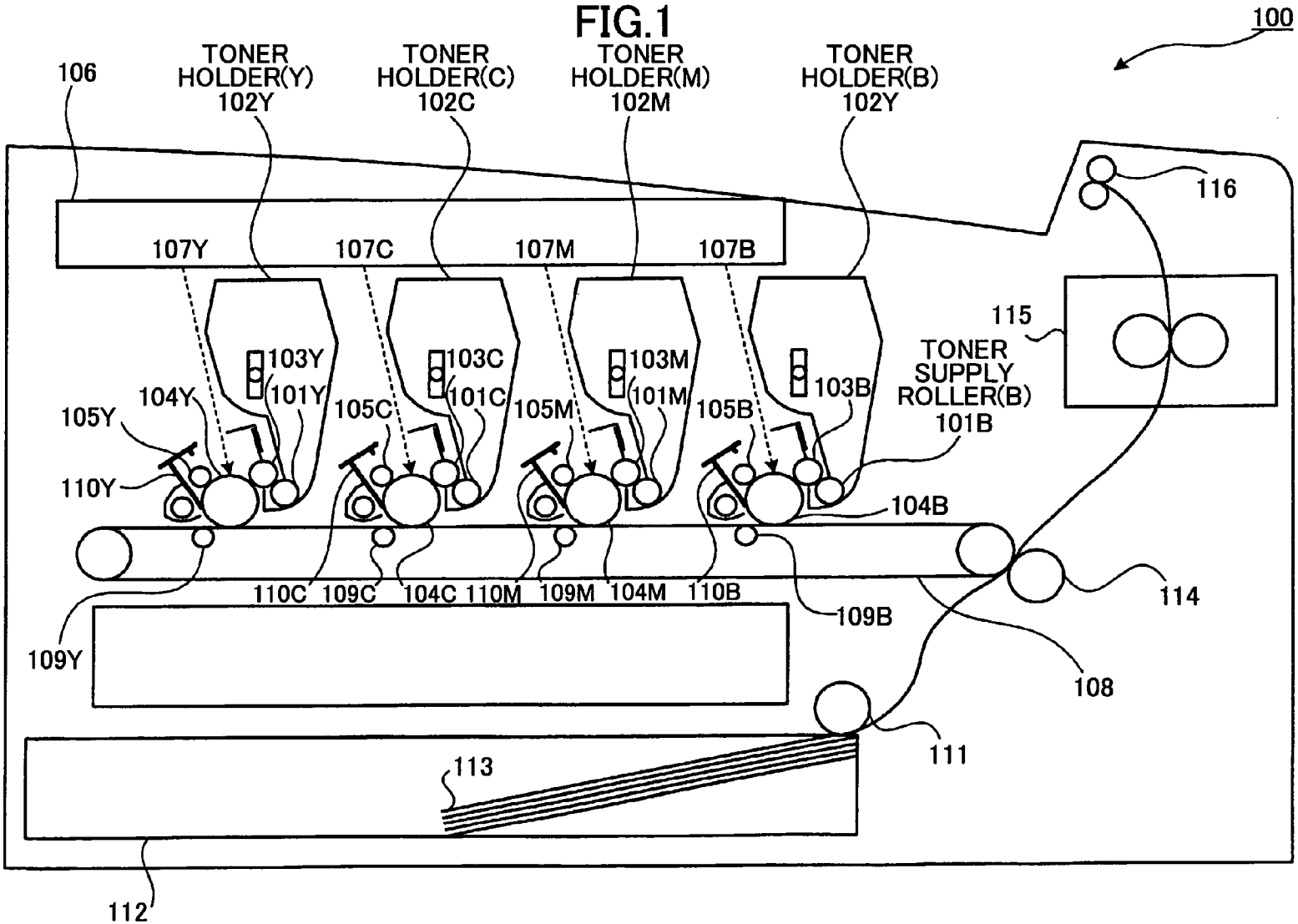
FIG. 1 is a cutaway view of an image formation apparatus according to an exemplary embodiment.

In the following, embodiments of the image formation apparatus, the image formation method, an image formation program, and the computer-readable recording medium of the present invention are described with reference to the accompanying drawings.

Embodiment

First, an image formation apparatus 100 according to the embodiment of the present invention is described with reference to FIG. 1, which is a cutaway view of the image formation apparatus 100 configured according to the embodiment of the present invention. The image formation apparatus 100 includes:

toner (developer) supply rollers 101B, 101M, 101C, and 101Y, collectively referenced as 101;

toner (developer) holders 102B, 102M, 102C, and 102Y, collectively referenced as 102;

development units 103B, 103M, 103C, and 103Y, collectively referenced as 103;

photo conductors 104B, 104M, 104C, and 104Y, collectively referenced as 104;

electrification units 105B, 105M, 105C, and 105Y, collectively referenced as 105;

an exposure unit 106;

a transfer belt 108;

primary transfer rollers 109B, 109M, 109C, and 109Y, collectively referenced as 109;

cleaner blades 110B, 110M, 110C, and 110Y, collectively referenced as 110;

a feed roller 111;

a paper feed tray 112;

a recording medium (paper) 113;

a secondary transfer roller 114;

a fixing assembly 115; and a delivery roller 116.

The image formation apparatus 100 is of a tandem type wherein the toner holders 102B, 102M, 102C, and 102Y containing toner of colors black (B), magenta (M), cyan (C), and yellow (Y), respectively, are arranged along the transfer belt 108.

With reference to FIG. 1, the transfer belt 108 rotates counterclockwise, and the toner holders 102B, 102M, 102C, and 102Y are arranged in this sequence from the upstream side of rotation of the transfer belt 108. The toner holders 102B, 102M, 102C, and 102Y are identical to each other, except that each toner holder contains toner of a uniquely assigned color as described above. Then, in the following, the toner holder 102B and the toner supply roller 101B are described as the representatives of the toner holders 102 and the toner supply rollers 101, respectively.

When forming an image, the toner supply roller 101B shown in FIG. 1 is rotated clockwise (the clockwise rotational direction is called a "positive direction", a rotation in the positive direction is called a "positive rotation", a counterclockwise rotational direction is called a "negative direction", and a rotation in the negative direction is called a "negative rotation"), and supplies black toner contained in the toner holder 102B to the corresponding development unit 103B. The rotational speed of the toner supply roller 101B can be adjusted between 50 mm/sec and 160 mm/sec, where the rotational speed of 160 mm/sec is called a "full speed".

The surface of the photo conductor 104B is uniformly charged by the electrification unit 105B. Then, the exposure unit 106 irradiates and exposes a laser light 107B corresponding to the image of black onto the photo conductor 104B that is uniformly charged by the electrification unit 105B. In this way, an electrostatic latent image of the black image is formed on the photo conductor 104B.

The development unit 103B forms a toner image by applying the black toner to the electrostatic latent image, and the black toner image is formed on the photo conductor 104B. The black toner image is transferred onto the transfer belt 108 by the primary transfer roller 109B at a primary transfer position where the photo conductor 104B and the transfer belt 108 make contact. In this way, the toner image formed with the black toner is placed on the transfer belt 108. Then, the cleaner blade 110B wipes away residual toner that remains on the surface of the photo conductor 104B so that it is ready for the next image formation. Similarly, toner images in magenta, cyan, and yellow are formed on the transfer belt 108 so that all the toner images may be superposed.

The secondary transfer roller 114 transfers the superposed toner image to the paper 113 conveyed from the paper feed tray 112 with the feed roller 111. Then, the fixing assembly 115 fixes the toner image to the paper 113. Then, the paper 113 on which the toner image is fixed is discharged to the exterior of the image formation apparatus 100 by the delivery roller 116.

Now, in image formation, low-speed printing is performed when, e.g., printing onto pasteboard, and printing at high density. If low-speed printing is continuously performed for a long time, since the flow of the toner in the vicinity of the toner supply rollers 101 becomes slow, there is a problem in that toner plugging of the toner supply rollers 101 is generated. If the operation is forced to continue with toner plugging occurring, the amount of the toner being supplied to the photoconductors 104 falls, and printing consistency becomes low. In the worst case, the toner supply rollers 101 may be damaged, and use of the image formation apparatus 100 may become impossible. Then, the image formation apparatus 100 according to the embodiment of the present invention prevents toner plugging by controlling the rotational speed, the rotational direction, and the rotation time of the toner supply rollers 101 before, during, and after image formation.

Figure 2:
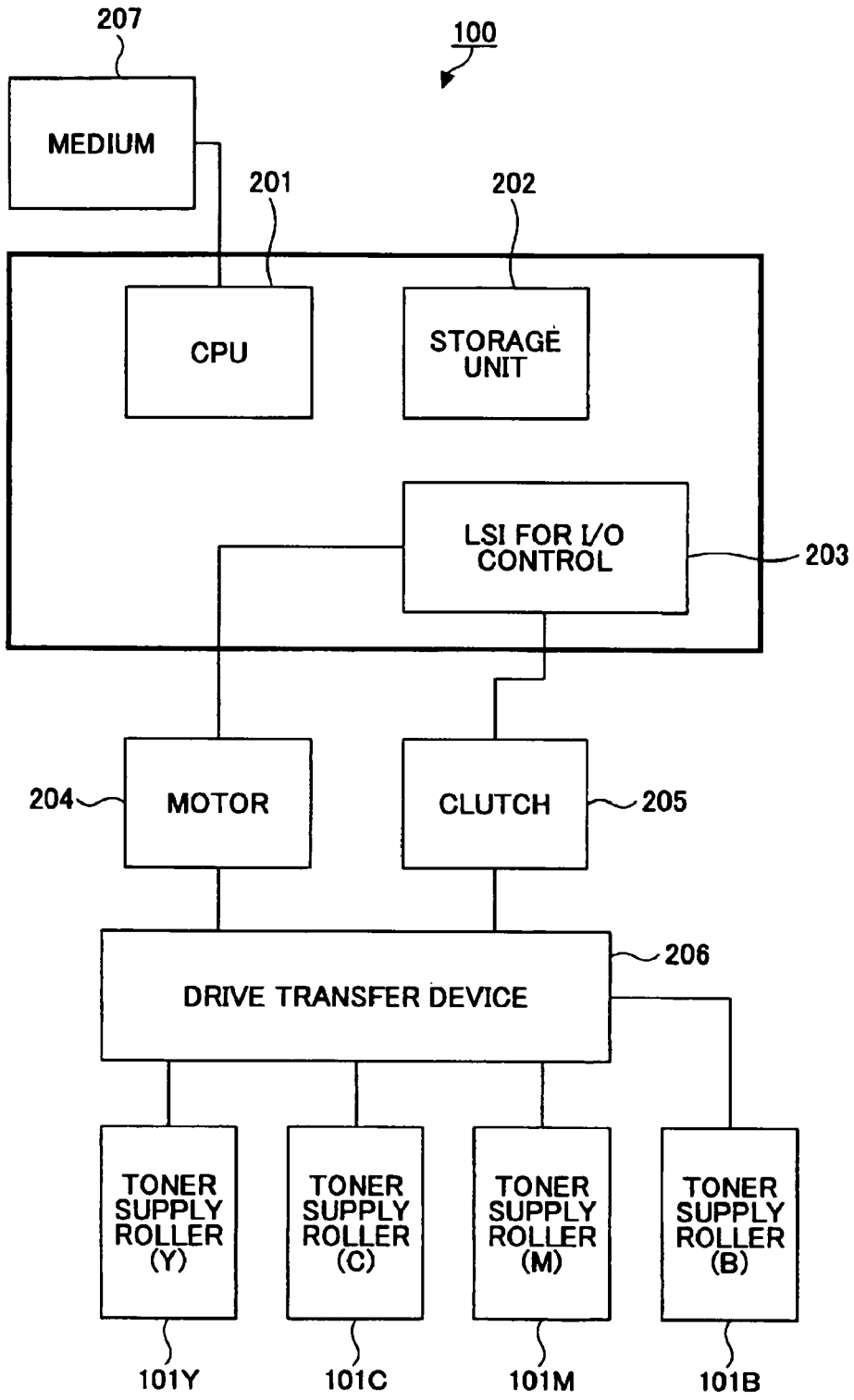
FIG. 2 is a hardware block diagram of the image formation apparatus according to the exemplary embodiment of FIG. 1.
Figure 2A:
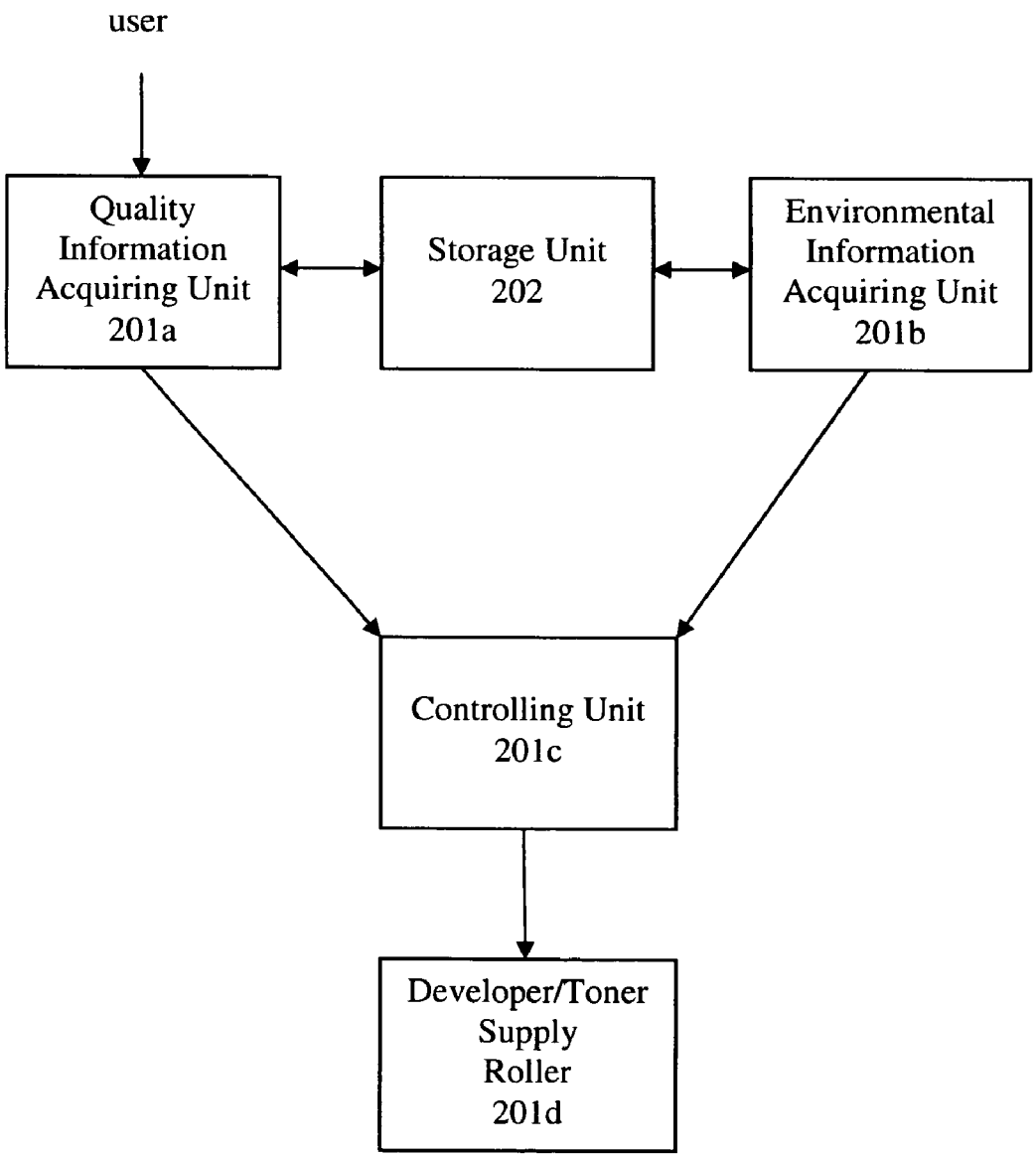
FIG. 2A is a schematic diagram illustrating an aspect of the image formation apparatus of FIG. 1.

Next, the hardware configuration of the image formation apparatus 100 according to the embodiment of the present invention is described with reference to a block diagram in FIG. 2. As shown in FIG. 2, the image formation apparatus 100 includes a CPU 201, a storage unit 202, an LSI 203 for I/O control, a motor 204, a clutch 205, a drive transfer device 206, and the toner supply rollers 101B, 101M, 101C, and 101Y, and a computer-readable recording medium 207 such as a CD-ROM for storing the image formation program.

The CPU 201 is for controlling processes of the image formation apparatus 100. Further, the CPU 201 performs a toner plugging preventive operation before image formation, during image formation, and after image formation. The storage unit 202 stores information about the rotational speed, the rotational direction, and the rotation time of the toner supply rollers 101 for the toner plugging preventive operation.

Further, the CPU 201 controls the motor 204 and the clutch 205 by the LSI 203 for I/O control. The motor 204 is for rotating the toner supply rollers 101 through the drive transfer device 206. Further, the clutch 205 is for stopping the rotation of the toner supply rollers 101 through the drive transfer device 206. The rotational speed, the rotational direction, and the rotation time of the toner supply rollers 101 can be adjusted by the CPU 201 controlling the motor 204 through the LSI 203 for I/O control.

Next, the toner plugging preventive operation performed by the image formation apparatus 100 according to the embodiment of the present invention is described with reference to a table given in FIG. 3. First, a critical rotational speed S at which toner plugging may occur is described. The critical rotational speed S varies with the operational environment (such as temperature and humidity), quality and magnitude of the toner, the toner supply roller 101, and the toner holder 102. Here, about the configuration shown in FIG. 1, parameters Z are defined, namely, the diameter of toner (grain) is about 8 μm, the diameter of the toner supply rollers 101 is about 10 mm, and the smallest distance between the wall of each toner holder 102 and the corresponding toner supply roller 101 is about 0.75 mm. With the parameters Z, experiments conducted by the inventor hereto show that toner plugging can occur at a rotational speed of 60 mm/s or less. Accordingly, the critical rotational speed S is defined as 60 mm/s.

Further, the experiments show that the probability of toner plugging occurring depends on the time or the number of sheets processed when the toner supply rollers 101 are rotating below the critical rotational speed S. Specifically, if the operational environment is poor with the parameters Z, whenever one sheet is printed, toner plugging may occur; if the operational environment is normal, toner plugging may occur in 300 seconds or more; and if the operational environment is good, toner plugging does not occur.

Further, the experiments show how long the non-operating state of the toner supply rollers 101 may last before the toner plugging preventive operation should start. Specifically, with the parameters Z, toner plugging may occur if the non-operating state lasts 24 hours or more (non-operating state is such as a power source being turned off, or being in an energy-saving mode). Further, in the case that the non-operating state continues 24 hours or more, the experiments show that toner plugging can be fully prevented if the toner supply rollers 101 are rotated at the full speed in the positive direction for 2 seconds.

Next, the rotational speed of the toner supply rollers 101, at which rotational speed toner plugging can be prevented, is described. The experiments show that toner plugging can be prevented if the rotational speed of the toner supply rollers 101 is 150 mm/s or greater with the parameters Z.

Further, the experiments show that, with the parameters Z, toner plugging of the toner supply rollers 101 can be prevented if the toner supply rollers 101 are rotated at the full speed (160 mm/s) for 2 to 10 seconds in either of the positive and the negative directions. Specifically, when the operational speed of the toner supply rollers 101 is less than the critical rotational speed S (60 mm/s), at which speed toner plugging may be generated, toner plugging can be prevented by rotating the toner supply rollers 101 at the full speed for 10 seconds if during the operation, at the full speed for 2 seconds if resuming operations from the non-operating state, and at the full speed for 4 seconds in the positive direction and at the full speed for 2 seconds in the negative direction if entering the non-operating state.

Information about the contents (specific operations) of the toner plugging preventive operation that the image formation apparatus 100 performs is defined based on the experimental results, which information is stored in the storage unit 202. FIG. 3 is a table showing the contents of the toner plugging preventive operation that the image formation apparatus 100 according to the embodiment of the present invention performs. With reference to FIG. 3, the image formation apparatus 100 performs the toner plugging preventive operation based on the kind of printing request that is input by a user. Here, for example, three kinds are offered, namely, speed important, normal, and quality important. Further, the toner plugging preventive operation is based on the environmental conditions, which conditions are, for example, poor, normal, and good. Here, the CPU 201 determines the environmental condition based or operational environmental factors such as temperature and humidity.

For example, if the printing request that the user has input is "speed important", and if the environmental condition is "poor", the toner supply rollers 101 are rotated at the full speed in the positive direction for 10 seconds every 600 seconds during printing as shown in FIG. 3. Then, after printing, the toner supply rollers 101 are rotated at the full speed for 4 seconds in the positive direction, and at the full speed in the negative direction 2 seconds. If the printing request that the user has input is "normal", and if the environmental condition is "normal", the toner supply rollers 101 are rotated at the full speed in the positive direction for 10 seconds every 300 seconds during printing as shown in FIG. 3. Then, after printing, the toner supply rollers 101 are rotated at the full speed in the positive direction for 4 seconds, and then are rotated at the full speed in the negative direction for 2 seconds. Further, if the printing request that the user has input is "quality important", and if the environmental condition is "good", the toner supply rollers 101 are rotated at the full speed in the positive direction for 2 seconds before printing as shown in FIG. 3.

Figure 4:
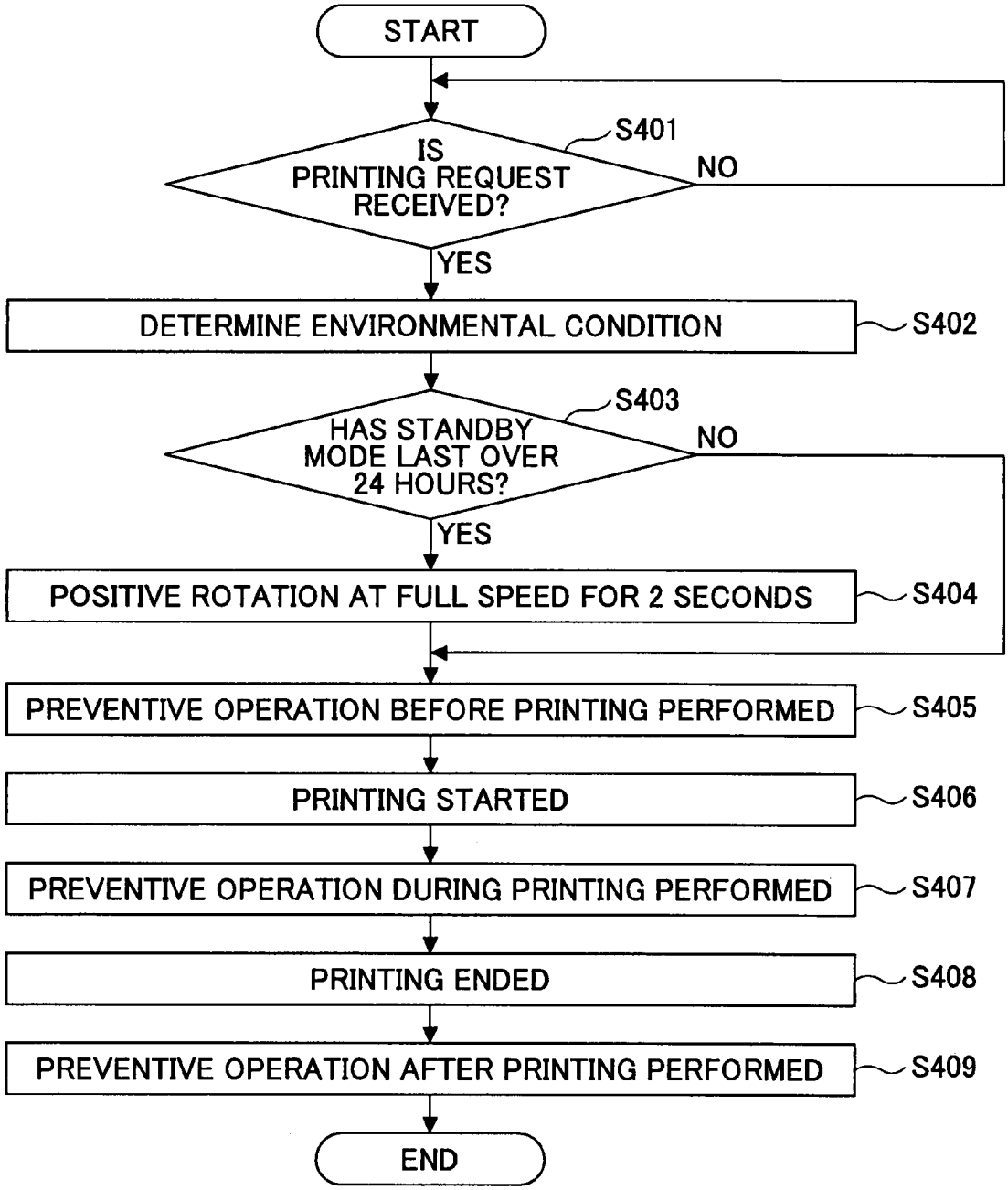
FIG. 4 is a flowchart of the toner plugging preventive operation carried out by the image formation apparatus according to the exemplary embodiment of FIG. 1.

Next, with reference to FIG. 4, process steps of the toner plugging preventive operation carried out by the image formation apparatus 100 according to the embodiment of the present invention are described. FIG. 4 is a flowchart that shows the process steps of the toner plugging preventive operation. As shown in FIG. 4, first, whether the CPU 201 receives a printing request is determined at step S401. The printing request is issued by the user operating a control panel (not illustrated). Here, three choices are available as for the printing request in this example as described above, namely, speed important, normal, and quality important.

At step S401, if no printing request is received (No at step S401), the process returns to step S401; and if the printing request is received (Yes at step S401), the process proceeds to step S402 wherein the CPU 201 determines the environmental condition. Three environmental conditions are available for selection in this example as described above, namely, poor, normal, and good. The CPU 201 determines a choice based on operational environment factors such as temperature and humidity.

Then, at step S403, the CPU 201 determines whether the non-operating state has lasted for 24 hours or more. If the determination is negative (No at step S403), the process proceeds to step S405 wherein the toner plugging preventive operation before printing is performed.

Otherwise, if the determination at step S403 is affirmative (Yes at step S403), the CPU 201 causes the toner supply rollers 101 to rotate at the full speed in the positive direction for 2 seconds at step S404. Specifically, the CPU 201 rotates the motor 204 through the LSI 203 for I/O control, and rotates the toner supply rollers 101 at the full speed in the positive direction for 2 seconds through the drive transfer device 206.

Then, at step S405, the CPU 201 performs the toner plugging preventive operation before printing. Specifically, if, for example, the printing request acquired at step S401 is "quality important", and if the environmental condition determined at step S402 is "normal", the information for the toner plugging preventive operation before printing corresponding to "quality important" and "normal" environment is read from the storage unit 202 (refer to FIG. 3), and the toner supply rollers 101 are rotated at the full speed in the positive direction for 2 seconds.

Then, at step S406, the CPU 201 starts printing. While printing, the CPU 201 performs the toner plugging preventive operation during printing at step S407. For example, if the printing request acquired in step S401 is "quality important", and the environmental condition determined at step S402 is "normal", the CPU 201 reads the information about the toner plugging preventive operation during printing corresponding to "quality important" and "normal" environment from the storage unit 202 (refer to FIG. 3), and rotates the toner supply rollers 101 at the full speed in the positive direction for 10 seconds every 300 seconds during printing.

Then, the CPU 201 ends printing at step S408. After printing, the CPU 201 performs the toner plugging preventive operation after printing at step S409, and the series of processes is ended. Specifically, for example, if the printing request acquired in step S401 is "quality important" and the environmental condition determined in step S402 is "normal", the toner plugging preventive operation after printing is rotating the toner supply rollers 101 at the full speed in the positive direction for 4 seconds and rotating the toner supply rollers 101 at the full speed in the negative direction for 2 second as shown in FIG. 3.

As described above, according to the embodiments of the present invention, the image formation apparatus, the image formation method, the image formation program, and the computer-readable recording medium can be provided. According to them, plugging by toner can be prevented by only controlling the rotation of the toner supply roller so that the apparatus breakdown and damage can be prevented.

The embodiment of the image formation method as described above can be realized by a computer, such as a personal computer or a workstation, executing a program comprising the above process steps beforehand prepared. The program may be stored in a computer-readable recording medium such as a hard disk, a flexible disk, a CD-ROM, and a DVD, and is executed by the computer reading from the recording medium. Further, the program may be obtained through a transmission medium that can distribute the program through networks such as the Internet.

AVAILABILITY TO INDUSTRY

As described above, the image formation apparatus, the image formation method, the image formation program, and the computer-readable recording medium of the present invention are useful to in multifunction machines having, e.g., copying, facsimile, and printer functions; and are especially suitable for a copying machine that reads a manuscript and prints an output.

Further, the present invention is not limited to these embodiments, but variations and modifications may be made without departing from the scope of the present invention.

The present application is based on Japanese Priority Application No. 2006-032388 filed on Feb. 9, 2006 with the Japanese Patent Office, the entire contents of that are hereby incorporated by reference.

What is claimed is:

1. An image formation apparatus wherein a developer supply roller supplies a developer held in a developer holder to a development unit, the image formation apparatus comprising:

a quality information acquiring unit for acquiring quality information chosen by a user out of a plurality of predefined quality information sets about quality of image formation;

an environmental information acquiring unit for acquiring environmental information about a present operational environment of the image formation out of a plurality of predefined environmental information sets; and a controlling unit, wherein the controlling unit determines a plugging preventative operation from the quality information acquired via the quality information acquiring unit and the environmental information acquired via the environmental information acquiring unit, and controls rotation of the developer supply roller according to the determined plugging preventative operation, and wherein the developer supply roller is the most upstream roller with respect to a developer feeding direction from the developer holder.

2. The image formation apparatus as claimed in claim 1, comprising:

a storage unit for storing a table wherein the quality information and the environmental information are associated with information about contents of control performed by the controlling unit; wherein the controlling unit controls a rotational speed, a rotational direction, and a rotation time of the developer supply roller based on the table stored in the storage unit.

3. The image formation apparatus as claimed in claim 2, wherein the controlling unit controls the developer supply roller with a combination of control performed before the image formation, control performed during the image formation, and control performed after the image formation based on the table stored in the storage unit.

4. The image formation apparatus as claimed in claim 1, wherein the controlling unit measures an interval, during which interval the image formation apparatus has not been operated, and rotates the developer supply roller at a predetermined speed for a predetermined period before the image formation if the measured interval is greater than a predetermined interval.

5. An the image formation method of an image formation apparatus wherein a developer supply roller supplies a developer held in a developer holder to a development unit, the image formation method comprising:

a quality information acquisition step of acquiring quality information chosen by a user out of a plurality of predefined quality information sets about quality of image formation;

an environmental information acquisition step of acquiring environmental information about a present operational environment of the image formation out of a plurality of predefined environmental information sets; and a control step of determining, by a controlling unit of the image formation apparatus, a plugging preventative operation from the quality information acquired in the quality information acquisition step and the environmental information acquired in the environmental information acquisition step, and controlling, by the controlling unit of the image formation apparatus, rotation of the developer supply roller according to the determined plugging preventative operation, and wherein the developer supply roller is the most upstream roller with respect to a developer feeding direction from the developer holder.

6. The image formation method as claimed in claim 5, wherein the control step controls a rotational speed, a rotational direction, and a rotation time of the developer supply roller based on stored information, wherein contents of control are associated with the quality information and the environmental information.

7. The image formation method as claimed in claim 6, wherein the control step controls the developer supply roller with a combination of control performed before the image formation, control performed during the image formation, and control performed after the image formation based on the stored information.

8. The image formation method as claimed in claim 5, wherein the control step measures an interval, during which interval the image formation apparatus has not been operated, and rotates the developer supply roller at a predetermined speed for a predetermined time before the image formation, if the measured interval is greater than a predetermined interval.

9. A non-transitory computer-readable recording medium for storing an image formation program to perform the image formation method as claimed in claim 5.

10. The image formation apparatus as claimed in claim 1, wherein the developer supply roller directly contacts the toner contained in the developer holder.

11. The image formation apparatus as claimed in claim 1, wherein the controlling unit controls direction and time of the rotation of the developer supply roller in accordance with the environmental information.

* * * * *